US006290270B1

(12) United States Patent
Spiessl

(10) Patent No.: US 6,290,270 B1
(45) Date of Patent: Sep. 18, 2001

(54) DOOR LOCK FOR AN ELECTRICAL HOUSEHOLD APPLIANCE

(75) Inventor: Georg Spiessl, Altendorf/Willhof (DE)

(73) Assignee: Elektromanufactur Zangenstein Hanauer GmbH & Co. KGAA (DE)

( * ) Notice: Subject to any disclaimer, the term of this patent is extended or adjusted under 35 U.S.C. 154(b) by 0 days.

(21) Appl. No.: 09/354,807

(22) Filed: Jul. 16, 1999

(30) Foreign Application Priority Data

Jul. 28, 1998 (DE) ..... 198 33 948
Aug. 17, 1998 (DE) ..... 198 37 248

(51) Int. Cl.[7] ..... E05C 3/16
(52) U.S. Cl. ..... 292/226; 292/216
(58) Field of Search ..... 292/59, 66, 68, 292/216, 220, 222, 223

(56) References Cited

U.S. PATENT DOCUMENTS

| | | | | |
|---|---|---|---|---|
| 1,573,866 | * | 2/1926 | Rogers | 292/113 |
| 2,138,251 | * | 11/1938 | Lindstrom | 292/198 |
| 2,833,578 | * | 5/1958 | Burke | 292/71 |
| 3,985,023 | * | 10/1976 | Guth | 70/267 |
| 4,398,747 | * | 8/1983 | Bernard | 280/630 |
| 4,497,513 | * | 2/1985 | Saski | 292/217 |
| 5,440,103 | * | 8/1995 | Martin | 219/413 |
| 6,048,001 | * | 4/2000 | Miller | 292/198 |

FOREIGN PATENT DOCUMENTS

| | | | |
|---|---|---|---|
| 43 17 135 | 9/1994 | (DE) | E05C/3/24 |
| 44 24 201 C2 | 5/1996 | (DE) | E05C/3/24 |
| 195 04 797 C2 | 4/1997 | (DE) | E05C/3/24 |
| 43 43 975 C2 | 4/1997 | (DE) | E05C/3/24 |
| 195 40 843.8 | 7/1998 | (DE) | E05C/3/24 |

* cited by examiner

*Primary Examiner*—Gary Estremsky
(74) *Attorney, Agent, or Firm*—Clifford W. Browning; Woodard, Emhardt, Naughton, Moriarty & McNett

(57) ABSTRACT

A door lock for an electrical household appliance has a framework 10 with an opening 36 for a hook 38, and in the framework a locking element and a locking spring 16 which is arranged between the locking element and an abutment 18 in the framework and is subjected to stressing when the door lock is in an open position, it being the case that the door lock has a movable gripping device 20 which is connected to the locking element and, when the door lock is in the open position, is pressed by the locking spring 16, at a contact location 28, against a part 26 of the framework or in the framework and thus prevents the spring from being relieved of stressing, and the gripping device 20 has a gripping latch 34 into which the hook can be guided as it comes in through the opening 36 of the framework, and which has a contact surface 42 on which the incoming hook presses and thus causes the gripping device 20 to move, and the gripping device 20 is formed such that, in the event of movement, it loses the contact with the contact location and the locking spring can thus be relieved of stressing.

3 Claims, 2 Drawing Sheets

DOOR LOCK FOR AN ELECTRICAL HOUSEHOLD APPLIANCE

Figure 1:
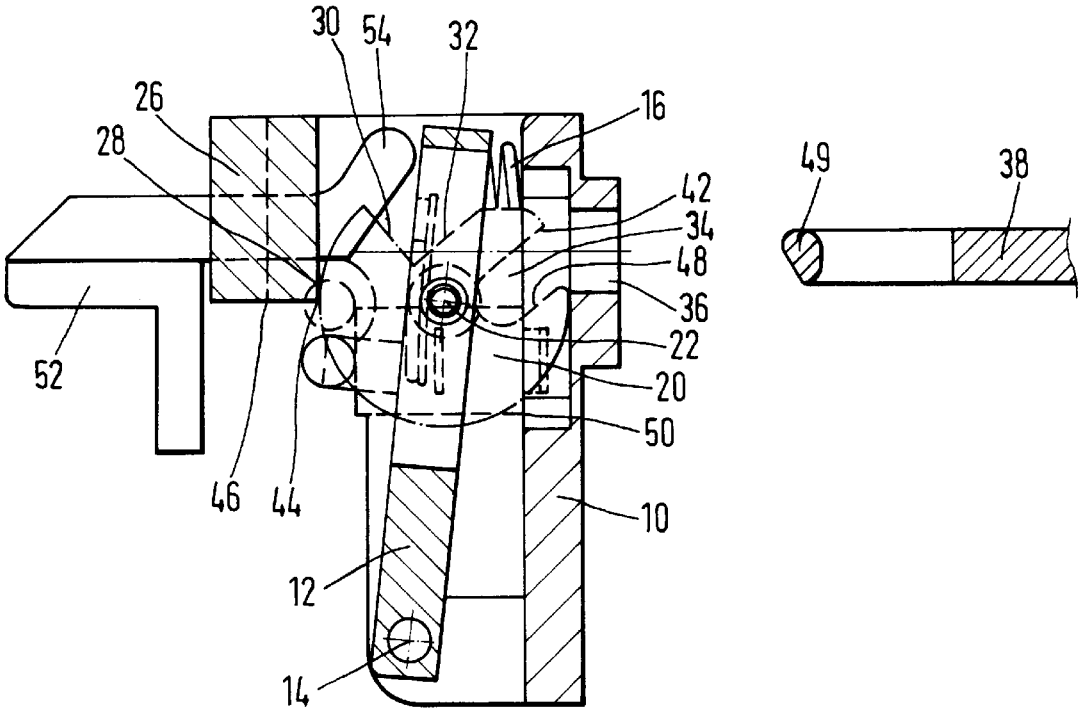

The invention relates to a door lock for an electrical household appliance, in particular for a dishwasher.

With electrical household appliances such as a dishwasher, the door lock may be installed both in the door and in the appliance casing. A hook is located on the other of the two parts in each case and, when the door is closed, is introduced into the lock and hooks in there.

Current door locks lock with either a force fit or a form fit.

A form-fit door-lock system is known, for example, for DE 43 17 135 C2. Form-fit systems are location-specific, i.e. the latching-in position of the locking hook is defined. In order to ensure that the door of the appliance seals well but can also be easily closed, the locking hook has to be adjusted precisely in terms of its longitudinal alignment. The tolerance level permissible here is relatively low. Adjustment is time-consuming and, in addition, incorrect adjustment results in a lot of time being lost during production.

A force-fit door-lock system is known, for example, from DE 195 40 843.8 and DE 43 43 975 C2. In such systems, as the door is closed, the hook engages in a mouthpiece of a so-called pivot flap and rotates the pivot flap. At the same time, a spring which is prestressed in the opening direction is compressed up to a changeover point, the spring then being relieved of pressure in the closing direction and thus closing the door and drawing it against the seal. The pivot flap provides just a relatively short lever arm, with the result that the force by which the door-lock system draws the door closed depends very precisely on the height position of the hook. Here too, hook-related tolerances pose problems.

DE 195 04 797 C2 describes a locking device for the door of a dishwasher, having a lever-like locking element which is connected to a gripping device which contains a latch.

The object of the invention is to provide a door lock which is intended for an electrical household appliance and does not have the abovementioned disadvantages as far as the hook-position tolerances are concerned.

The object is achieved according to the invention by a door lock for an electrical household appliance having a framework with an opening for a hook, a locking element, such as a locking lever (12) in the framework, and a locking spring which is arranged between the locking element and an abutment in the framework, it being the case that the locking spring is subjected to stressing when the door lock is in an open position, the door lock has a movable gripping device which is connected to the locking element and, when the door lock is in the open position, is pressed by the locking spring, at a contact location, against a part of the framework or in the framework, it being possible for said part of the framework to be, for example, of rigid design or to be designed as a roller, and thus prevents the spring from being relieved of stressing, and the gripping device has a gripping latch into which the hook can be guided as it comes in through the opening of the framework, and which has a contact surface on which the incoming hook presses and thus causes the gripping device to move, and the gripping device is formed such that, in the event of movement, it loses the contact with the contact location and the locking spring can thus be relieved of stressing.

When the locking spring is relieved of stressing, the locking element is moved, as is thus also the gripping device with the hook in the gripping latch. The door is thus closed. Since the locking spring does not have to act directly on the gripping device, that is to say the gripping of the locking hook and the closing operation itself are separate functions, the requirements to be met by the tolerance as far as the position of the hook is concerned are reduced to a considerable extent.

The locking spring may be subjected to stressing by a motor provided in the door lock, but the door lock preferably has an opening lever which can be pressed against the locking element, with the result that the locking spring is compressed when the opening lever is actuated. It is usually the case that, when a door is opened, an opening lever is guided toward the appliance body and, with this movement, the necessary force can easily be applied.

The locking element advantageously has a locking lever which can be pivoted about an axis. The locking spring advantageously presses on the locking lever at a location which is further away from the axis than the location at which the gripping device is connected to the locking lever, i.e. the locking-spring force acts on a larger lever than the hook when it engages in the gripping device.

The gripping device can preferably be rotated about an axis of rotation. In this case, the hook can be gripped particularly well since the opening of the gripping latch rotates such that it is no longer possible for the hook to escape out of the gripping device. A variant of the gripping device with a slide, however, is likewise possible.

During opening, the gripping device can be guided into its original rotary position again by the seal, or a special integrated set of springs, applying a force to the door and the hook being drawn out of the opening. However, the gripping device advantageously has a torsion spring which is subjected to stressing when the lock is in the locked position, with the result that, when the door is opened, the gripping device is moved into its original position by the torsion spring.

The gripping device advantageously has a circumference line which forms part of a circle about the axis of rotation and from which a sliding edge runs inward toward smaller radii at an angle of at least 450 from a tangent to the circumference line. The sliding edge advantageously runs toward a stop edge. If the gripping device butts against the contact location by way of the radial part of the circumference line, then it rotates, when a hook is introduced, without the locking element moving. If the sliding edge (of the gripping device) reaches an edge of the rigid part of the framework during rotation, the locking spring can be relieved of stressing and, with the movement of the locking element, the gripping device slides along the sliding edge until the movement is stopped, for example, by the stop edge. However, a surface in the framework (casing) may also serve as a stop for the locking element. In this case, the door is drawn against the seal via the locking element.

The sliding edge preferably runs radially in relation to the axis of rotation, and the stop edge is essentially perpendicular to the sliding edge.

The gripping latch is advantageously formed as a more or less radial, but eccentric recess in the circumference of the gripping device.

The door lock may also have two locking springs, for example in the case of a locking lever which is somewhat wider.

Alternatively, it is also possible for the locking element to be designed as a slide. Two locking springs advantageously press against the slide, and the gripping device is connected to the slide between the two springs.

Figure 2:
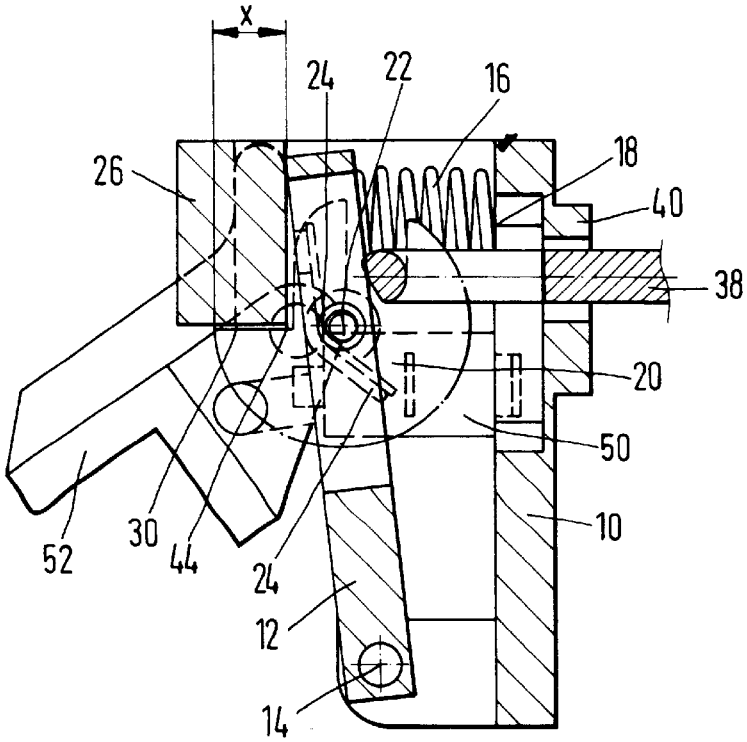
Figure 3:
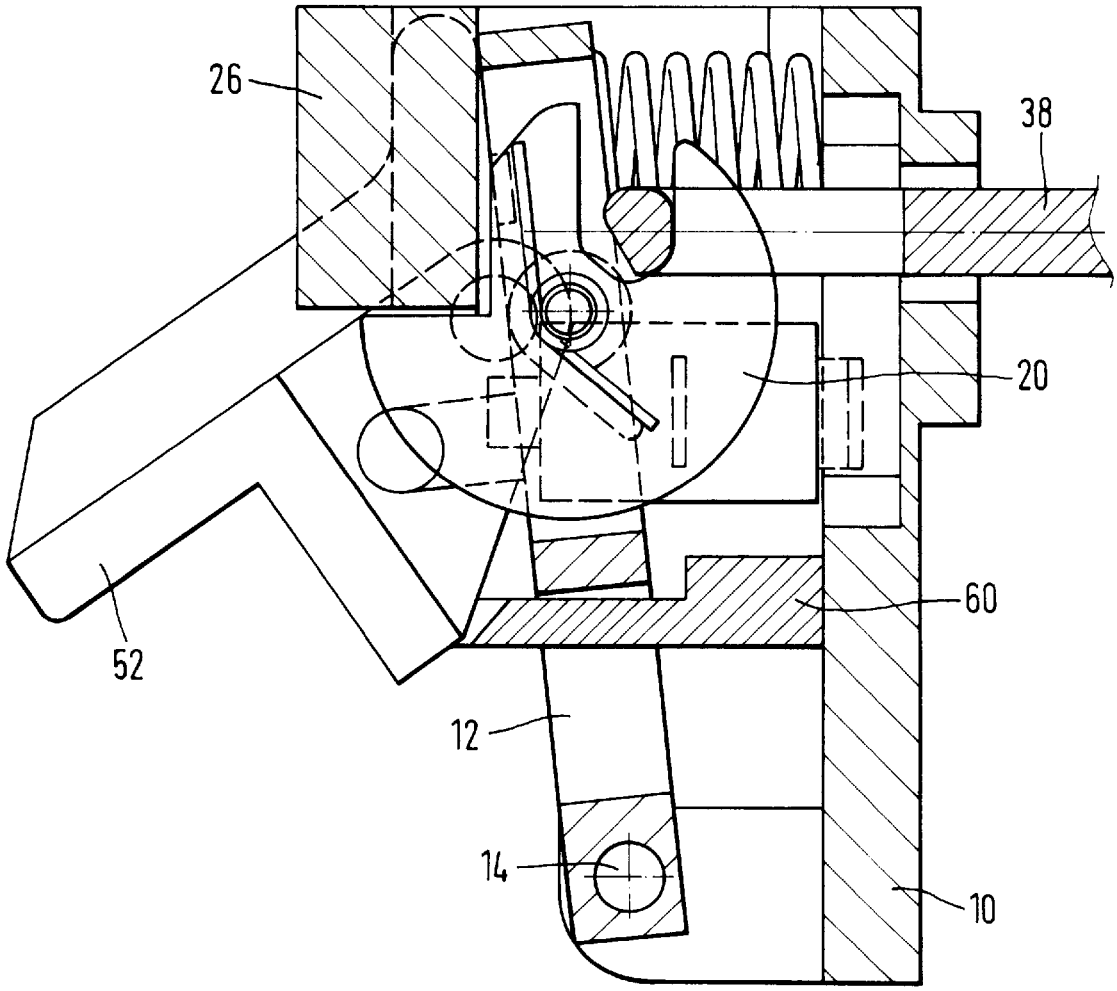

A preferred embodiment of the invention is described hereinbelow with reference to the drawing, in which:

FIG. 1 shows a section through a door lock for an electrical household appliance according to the invention in an open position, FIG. 2 shows a section through a door lock for an electrical household appliance according to the invention in the locked position, FIG. 3 shows a section through a door lock which, in relation to the exemplary embodiment according to FIGS. 1 and 2, is additionally provided with a catch.

Accommodated in a framework 10 is a locking lever 12 which can be pivoted about an axis 14. In the open position of the door lock, said position being shown in FIG. 1, a locking spring 16 is held under stress between the locking lever 12 and an abutment 18, that is to say it presses the locking lever in the counterclockwise direction.

A gripping device 20 is arranged on the locking lever 12 such that it can be rotated about an axis 22. The axis 22 of the gripping device is located on the locking lever 12 between the axis 14 of the locking lever and the region on which the locking spring 16 acts. The gripping device 20 has a circumference line which forms part of a circle about the axis of rotation. The locking spring 16 presses the gripping device 20 against a stop surface 28 of a stop body 26 of the framework 10. The circumference line of the gripping device 20 leads to a sliding edge which runs radially inward at an angle of 900 from a tangent to the circumference line of the gripping device. A stop edge 32 of the gripping device 20 is perpendicular to the sliding edge 30.

The gripping device 20 is arranged in a clearance of the locking lever 12. In the case of the exemplary embodiment illustrated, the-locking lever 12 is prestressed in the counterclockwise direction by two locking springs 16 (only one is shown in the figures). According to the illustration in FIGS. 1 and 2, it is thus the case that one locking spring 16 is located in front of the gripping device 20 and one locking spring is located behind the gripping device 20, as seen by the person looking at the drawing.

A gripping latch 34 is designed as an eccentric recess in the circumference of the gripping device. By way of its opening, when the door lock is in the open position, it is oriented in the direction of an opening 36 in the side 40 of the framework 10, said side being directed toward a hook 38. If the hook 38 is guided through the opening 36 as the door is closed, then it presses on a contact surface 42 of the gripping latch 34 and causes the gripping device 20 to rotate in the counterclockwise direction. As a result of the rotation, the sliding edge 30 passes onto a corner 44 of the framework 10. The locking spring 16 can be relieved of stressing, the locking lever 12 rotates about the axis 14, and the gripping device 20 thus slides, with the sliding edge 30, along a surface 46 of the framework 10, the sliding edge 30 being pressed against the surface 46 of the framework 10 by the torsion spring 24. The front part 49 of the hook 38 is in contact with a second contact surface 48 of the gripping latch 34 and is carried along by the gripping latch 34. In the process, the door is pressed against the seal. At the same time as these movements, a door switch 50, which is actuated via the locking lever 12, is closed, the torsion spring 24 is subjected to stressing and an opening lever 52 is moved, by the locking lever 12 acting on an arm 54 of the opening lever. This results in the locked position of the lock, said position being shown in FIG. 2.

When the lock is opened, the opening lever 52 is moved in the clockwise direction, and the arm 54 of the opening lever 52 presses the locking lever 12 in the clockwise direction and compresses the locking spring 16. In this case, the gripping device 20 slides, with the sliding edge 30, along the surface 46 of the framework 10 (to the right in FIG. 2) until, by virtue of the torsion spring 24 (possibly in conjunction with a seal pushing the door away from the appliance casing), the gripping device 20 is returned into the position which corresponds to the open position of the door lock, in which case the hook 38 is released and the door opens. At the same time as the lock is opened, the door switch 50 is also actuated, and opened, by the locking lever 12.

The length of the sliding edge 30 determines the hook-related tolerance in the closing direction. The front part 49 of the hook 38 cannot spring out of the gripping latch 34 as long as the gripping device 20 does not rotate, i.e. as long as the locking lever 12 rotates merely about its axis 14. This is an advantage over a large number of current door-lock systems, in which it is possible for the hook to spring out in this way, the lock returning into the locked position again following the spring-out action.

Overall, the door lock according to the invention also has the advantage that it may be of very flat design and thus saves space.

FIG. 3 shows a modification of the abovedescribed door lock to the effect that an additionally provided catch 60 prevents the closed door from opening as a result of forces from the inside or outside. In the case of the exemplary embodiment according to FIG. 3, the components otherwise correspond to the exemplary embodiment described above, so reference can be made to the relevant description thereof. The forces acting on the door may be, for example, a steam shock from the inside or a pulling-open action from the outside. The catch 60 may be designed, for example, as an edge on the framework 10 or else as an additional part. The catch 60 prevents the locking element 12 from rotating in the opening direction before the gripping device 20 is released via the sliding edge 30 at the corner 44. During opening by means of the opening lever 52, first of all the locking element 12 is released and then the door is opened, as has been described above.

In a modification, the abovedescribed exemplary embodiments of door locks may also be designed as so-called "pull-open locks". In this case, the opening lever 52 is dispensed with, with the result that opening is possible by virtue of pulling on a grip hollow or the like of the door.

What is claimed is:

1. A door lock for an electrical household appliance, in particular for a dishwasher, having:

a framework (10) with an opening (36) for a hook (38), a locking element in the framework, and a locking spring (16) which is arranged between the locking clement and an abutment (18) in the framework, the locking element being connected to a gripping device (20), wherein the gripping device (20), when the door lock is in an open position, is pressed by the locking spring, at a contact location (28), against a stop body (26) of the framework (10) and thereby prevents the locking element from moving, and the gripping device (20) has a gripping latch (34) into which the hook is guided as it comes in through the opening (36) of the framework, and which has a contact surface (42) that is adapted to be pressed by the incoming hook, wherein the gripping device (20) is caused to move if the incoming hook presses against said gripping device, and the gripping device is formed such that, when said gripping device is caused to move by the hook (38), said gripping device loses the contact with the contact location and the locking spring can thus move the locking element such that a closed position of the door lock is reached as a consequence of the effect of the locking spring, wherein the locking element is a locking lever (12) which can be pivoted about an axis (14), and wherein the locking spring (16) presses on the locking lever (12) at a location which is further away from the axis than the location at which the gripping device is connected to the locking lever.

2. A door lock for an electrical household appliance, in particular for a dishwasher, having:

a framework (10) with an opening (36) for a hook (38), a locking element in the framework, and a locking spring (16) which is arranged between the locking element and an abutment (18) in the framework, the locking element being connected to a gripping device (20), wherein the gripping device (20), when the door lock is in an open position, is pressed by the locking spring, at a contact location (28), against a stop body (26) of the framework (10) and thereby prevents the locking element from moving, and the gripping device (20) has a gripping latch (34) into which the hook is guided as it comes in through the opening (36) of the framework, and which has a contact surface (42) that is adapted to be pressed by the incoming hook, wherein the gripping device (20) is caused to move if the incoming hook presses against said gripping device, and the gripping device is formed such that, when said gripping device is caused to move by the hook (38), said gripping devise loses the contact with the contact location and the locking spring can thus move the locking element such that a closed position of the door lock is reached as a consequence of the effect of the locking spring, wherein the gripping device (20) has a torsion spring (24) which is subjected to stressing when the lock is in the locked position.

3. A door lock for an electrical household appliance, in particular for a dishwasher, having:

a framework (10) with an opening (36) for a hook (38), a locking element in the framework, and a locking spring (16) which is arranged between the locking element and an abutment (18) in the framework, the locking element being connected to a gripping device (20), wherein the gripping device (20), when the door lock is in an open position, is pressed by the locking spring, at a contact location (28), against a stop body (26) of the framework (10) and thereby prevents the locking element from moving, and the gripping device (20) has a gripping latch (34) into which the hook is guided as it comes in through the opening (36) of the framework, and which has a contact surface (42) that is adapted to be pressed by the incoming hook, wherein the gripping device (20) is caused to move if the incoming hook presses against said gripping device, and the gripping device is formed such that, when said gripping device is caused to move by the hook (38), said gripping devise loses the contact with the contact location and the locking spring can thus move the locking element such that a closed position of the door lock is reached as a consequence of the effect of the locking spring, wherein there is provided a catch (60) which prevents the door from being opened without actuation of an opening lever (52).

* * * * *